US007448521B2

(12) United States Patent
Hu

(10) Patent No.: US 7,448,521 B2
(45) Date of Patent: Nov. 11, 2008

(54) AUTOMATIC SHOE COVER DISPENSER

(76) Inventor: Quanxi Hu, Qian Huang Industrial Zone, Gu Shan Town, Yong Kang City, Zhe Jiang Province (CN)

( * ) Notice: Subject to any disclaimer, the term of this patent is extended or adjusted under 35 U.S.C. 154(b) by 541 days.

(21) Appl. No.: 11/280,867

(22) Filed: Nov. 16, 2005

(65) Prior Publication Data

US 2006/0144879 A1 Jul. 6, 2006

(30) Foreign Application Priority Data

Nov. 16, 2004 (CN) ..... 2004 2 0057515 U

(51) Int. Cl.
*A47G 25/80* (2006.01)
*A47G 25/90* (2006.01)

(52) U.S. Cl. ..... 223/111; 223/112; 223/120; 223/118; 221/232; 12/1 R

(58) Field of Classification Search ..... 221/232; 223/111, 112, 120, 118; 12/1 R
See application file for complete search history.

(56) References Cited

U.S. PATENT DOCUMENTS 5,593,071 A * 1/1997 Lusk ..... 223/112
5,878,909 A * 3/1999 Rogow ..... 221/45
6,056,171 A * 5/2000 Santamaria ..... 223/112
6,155,466 A * 12/2000 Migliorini ..... 223/77
6,234,369 B1 * 5/2001 Bort ..... 223/112
6,234,370 B1 * 5/2001 Kummerle et al. ..... 223/112
6,808,094 B1 * 10/2004 Hogg ..... 223/114
6,820,779 B1 * 11/2004 Wilson ..... 223/111
7,108,154 B1 * 9/2006 Thompson ..... 221/33
2005/0173476 A1 * 8/2005 Vouriot ..... 223/112
2007/0163912 A1 * 7/2007 Chen ..... 206/477
2007/0262101 A1 * 11/2007 Kneth ..... 223/111

* cited by examiner

*Primary Examiner*—Gene O. Crawford
*Assistant Examiner*—Rakesh Kumar
(74) *Attorney, Agent, or Firm*—Butzel Long

(57) ABSTRACT

An automatic shoe cover dispenser that includes a machine body, a traction and extension mechanism, a separation and hooking mechanism, a turning mechanism, a traction driving mechanism, and a shoe cover box. The body of the shoe cover box is equipped with a shoe cover separating exit. The separation and hooking mechanism extends into the shoe cover separating exit to pull out the shoe cover, and the traction and extension mechanism expands the shoe cover so that one merely has to insert a shoed foot into the stretched shoe cover with the tread of the shoe facing downwards. The advantages of the invention include its simple and rational structure, strong practicability, safety and reliability, and the use of a normal disposable shoe cover without special process and technical requirements, thus greatly reducing the costs of perishable items, and being affordable to a large quantity of consumers. In addition, the shoe cover dispenser has large capacity and allows for very convenient installation of shoe covers. The shoe cover installation quantity can be freely adjusted as desired and can reach a rate as high as dozens or even thousands of pairs of shoe covers before the shoe cover dispenser might need to be adjusted. The shoe cover dispenser can be widely used for household needs as well as various locations such as hospitals and scientific research institutes etc.

7 Claims, 7 Drawing Sheets

AUTOMATIC SHOE COVER DISPENSER

FIELD OF THE INVENTION

The present invention is related to sanitary accessories, and particularly a kind of automatic shoe cover dispenser which requires no shoe changing before entering a house, and which is widely applicable to various kinds of locations and different levels of consumer groups.

BACKGROUND OF THE INVENTION

At the present time existing shoe cover dispensers are either not rational in structure, or too costly. This is especially true for shoe cover dispensers that are required to use special matching shoe covers, and when the special shoe covers need to meet certain requirements in technology and process to be able to ensure proper operation of shoe cover dispensers, leading to the high price of expendable shoe covers so that they do not have the actual characteristics of being inexpensively priced, disposable items. It thus becomes difficult for consumers to afford such special shoe covers which are also difficult to match. These drawbacks restrict the promotion and development of shoe cover dispensers.

DETAILED DESCRIPTION OF THE INVENTION

The present invention provides a kind of automatic shoe cover dispenser that has a simple and reasonable design, does not involve special requirements for matching shoe covers, and is designed to use normal disposable shoe covers which are already popular in the market and accepted by most consumers.

The automatic shoe cover dispenser of the present invention includes a machine body which is in the structure of box body with an opening on the top end surface and slide rails on inner walls of both sides. A traction and extension mechanism, including a first slide rack, a second slide rack and traction hooks are provided at the end of the slide racks. The first and second slide racks are respectively provided on the sides of the machine body and equipped with stepped linkage orbital segments. A step is formed on the first slide racks, so that the step end surface cooperates with switching control orbital segments, namely KM, MN segments (discussed below). The second slide racks is formed with two discontinuous steps along the length direction so that two step end surfaces and the end surfaces between the two steps cooperates with turning control orbital segments, namely AB, BC, CD, DE, EF segments (discussed below). Guide rail rollers are also provided on the first and second slide racks and guide rail rollers are provided on the guide rail on the sides of the machine body. The automatic shoe cover dispenser further comprises a separation and hooking mechanism, including a support arm, first and second separating hooks, hook linkage arm, switching control guide rail, and guide rail linkage arm. The support arm is provided in the box body of the machine body. The first separating hook and the second separating hook are respectively connected to the support arm. The hook linkage arm is respectively in flexible connection with the first and second separating hooks, and connected to switching control guide rail. One end of guide rail linkage arm is connected to switching control guide rail and the other end is connected to the first slide rack set on the side of the machine body. The switching control guide rail is fixed on the inner side walls in the machine body. The automatic shoe cover dispenser further comprises a turning mechanism, including turning gears, upwards turning crank, downwards turning crank, and upwards turning gears. The turning gears are provided on the support arm. One end of the upwards turning crank and the downwards turning crank are connected to turning gears on the support arm and the other ends thereof are respectively connected to the second slide rack on the inner side of the machine body. Upwards turning crank interlocks with the turning gears of support arm through upwards turning gears, thus driving the first and second separating hooks on the support arm to turn Upwards. Downwards turning crank, in conjunction with the turning gears, drives the first and second separating hooks on the support arm to turn downwards. A traction driving mechanism is mounted on the machine and includes a motor, a motor gear, a transmission shaft, double transmission gears and control switches (S1-S4) (as discussed below). The motor drives the double transmission gear through the motor gear and transmission shaft. The transmission gear is connected to the first and second slide racks so that it can drive the first and second slide racks reciprocally. A shoe cover box is mounted to the support arm mounted on the machine body support arm so that its bottom penetrates the machine body to form the shoe covers stretching and separating opening for the traction and extension mechanism to extend into. Stoppers are mounted on the shoe cover separating exit. The storage box includes a shoe cover packaging box in which shoe covers are stacked so that the rubber band opening of shoe covers face the shoe cover separating exit.

The stoppers referred to above comprise symmetric stoppers which are raised towards the middle of the pull-out opening.

The box body and stoppers of shoe cover box are made from folded cardboard and the stoppers and box body are integrated.

A feeding block is mounted on the other end of the storage box corresponding to the shoe cover separating exit.

A spring is provided between the first separating hook and the second separating hook for connection therebetween.

A first upward hook and a second downward hook are formed on one end surface of the ends of the first and second separating hooks. In addition, a third hook is formed on the other end surface of the ends of the first and second separating hooks in the reverse direction of the second hook.

Photoelectric switches are provided along the length direction of slide rails on both sides inside the machine body and are respectively electrically connected to the traction driving mechanism. The photoelectric switches can switch the operation of traction driving mechanism off.

The advantages of the present invention include a simple and rational structure that provides strong practicability, safety and reliability, and which does not need to use special shoe covers with special processing and technology requirements. Rather the present invention uses normal disposable shoe covers without any special processing and technical requirements, thus greatly reducing the costs of expendable items and making the use of the invention affordable to a large quantity of consumers. This solves the problem that the practicability of existing shoe cover dispensers is poor because the prices of special shoe covers are high and the production and supply facilities of such shoe covers are not widespread. In addition, the shoe cover dispenser of the present invention has a large capacity and provides for very convenient installation of shoe covers. The shoe cover dispenser of the present invention has strong universality and a wide application range. The shoe cover installation quantity can be freely adjusted as desired and can reach a rate as high as dozens or even thousands of pairs of shoe covers before it might be necessary to make any adjustment. The shoe cover dispenser is widely applicable to household needs as well as various locations such as hospitals and scientific research institutes etc.

DESCRIPTION OF ATTACHED DRAWINGS

LIST OF REFERENCE NUMERALS

Figure 1:
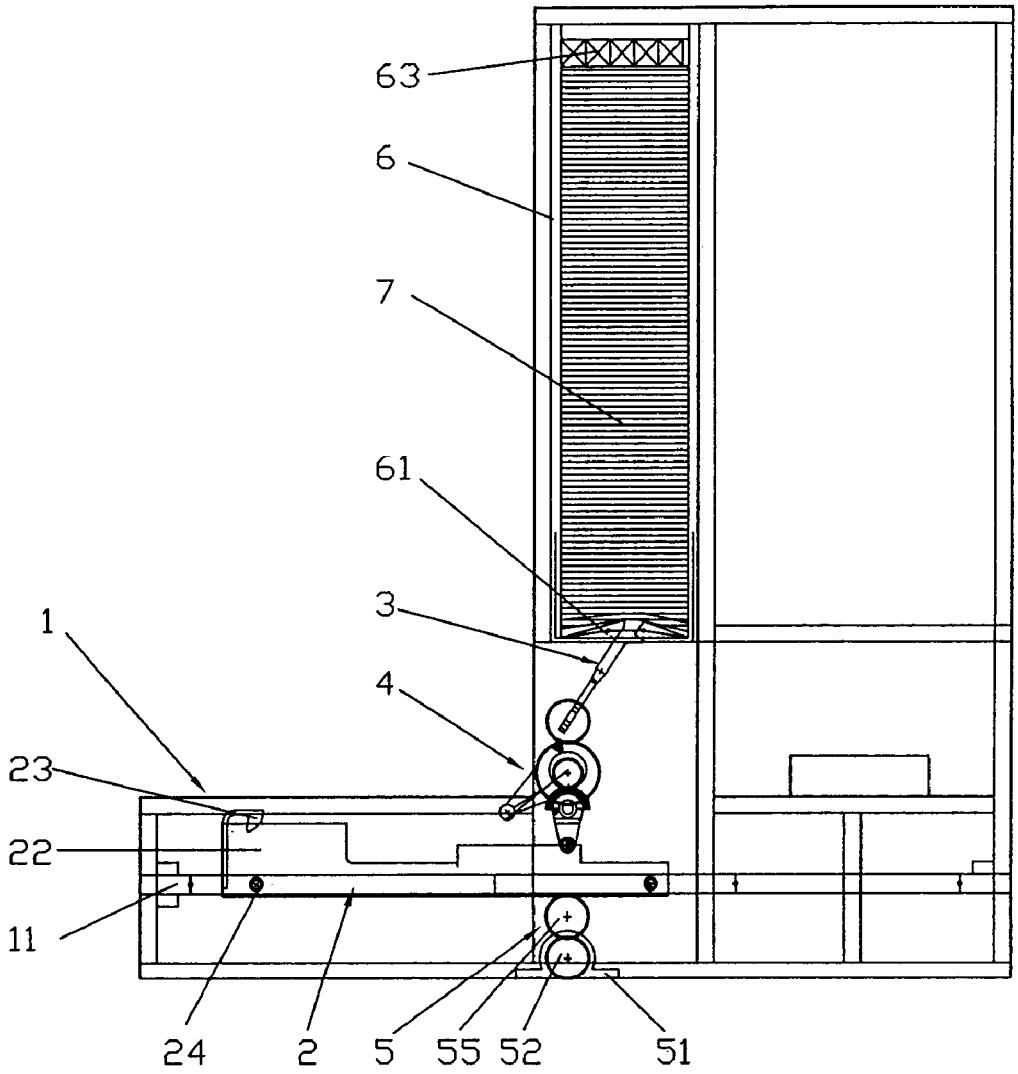
FIG. 1 is a schematic view of an automatic shoe cover dispenser according to one embodiment of the present invention.
Figure 2:
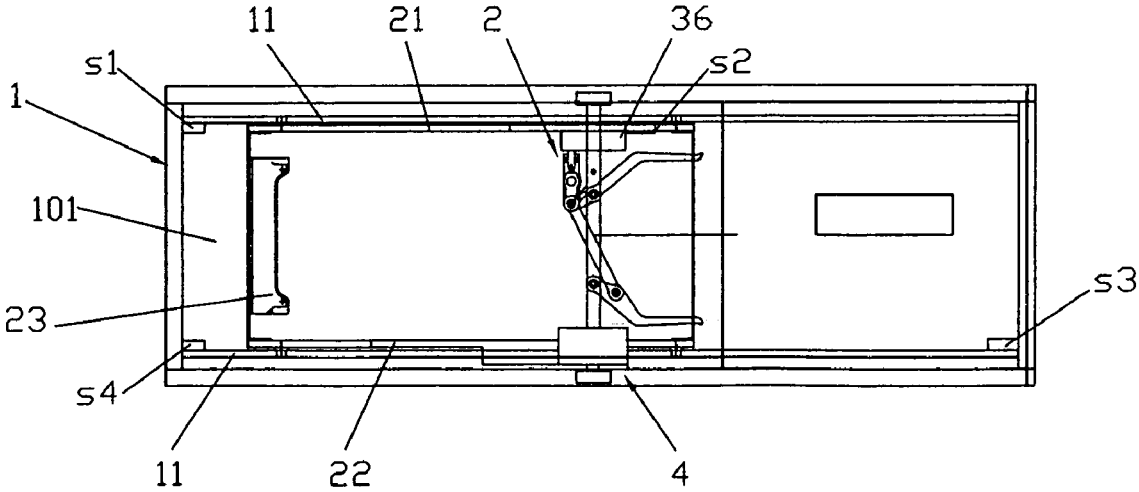
FIG. 2 is a top plan view of the automatic shoe cover dispenser of FIG. 1.

1 machine body
101 opening
11 slide rail
2 traction and extension mechanism
21 first slide rack
211 steps (KM, MN switching control orbital segments)
22 second slide rack
221, 222 steps (AB, BC, CD, DE, EF turning control orbital segments)
23 traction hook
24 slide rail rollers
3 separation and hooking mechanism
31 supporting arm
32 first separating hook
33 second separating hook
34, 35 hook linkage arms
36 switching control guide rail
37 guide rail linkage arm
38 springs
4 turning mechanism
41 turning gear
42 upwards turning crank
43 downwards turning crank
44 upwards turning gear
5 traction driving mechanism
51 motor
52 motor gear
53 transmission shaft
54, 55 double transmission gears
S1, S2, S3, S4 electrical appliance control switches
6 shoe cover box
61 shoe cover separating exit
62 stoppers
63 feeding block
7 shoe cover
71 rubber bands
L1 power source light
L2, L3 working lights
L4 trouble light
K1 starting switch
K2 stop switch
K3 setting switch
KM1, KM2 solenoids

BEST MODE FOR CARRYING OUT THE INVENTION

Referring to FIG. 1, the automatic shoe cover dispenser of the present invention comprises a machine body 1, a traction and extension mechanism 2, a separation and hooking mechanism 3, a turning mechanism 4, a traction driving mechanism 5, and a shoe cover box 6.

Machine body 1, which is in the structure of a box body, has an opening 101 on its top end surface and slide rails 11 on the inner walls of both sides.

Referring to FIGS. 1-5, the traction and extension mechanism 2 for the automatic shoe cover dispenser of the present invention includes a first slide rack 21, a second slide rack 22 and traction hooks 23 provided on the ends of the slide racks. The first and second slide racks 21, 22 are respectively provided on the inner side surfaces of the machine body 1 of the shoe cover dispenser, and the slide racks are provided with step-shaped linkage orbital segments. The end of the first slide rack 21 is raised to form a step 211. The end surface of step 211 is formed with switching control orbital segments, i.e., KM, MN segments. The second slide rack 22 is formed with two discontinuous steps 221, 222 in the length direction thereof. The end surfaces of these two steps 221, 222 and the end surface between the two steps provides turning control orbital segments, namely AB, BC, CD, DE, EF segments. Slide rail rollers 24 are also provided on the first and second slide racks 21, 22, and slide rail rollers 24 are engaged with the slide rails 11 at the side surface of the machine body.

Figure 3:
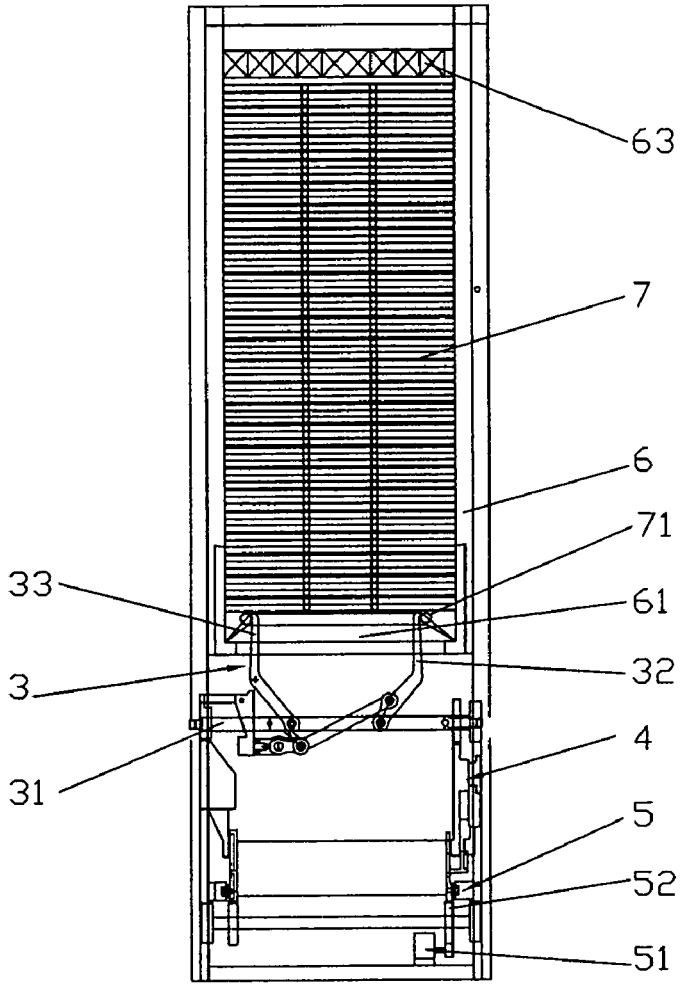
FIG. 3 is a side view of the automatic shoe cover dispenser of FIG. 1.
Figure 4:
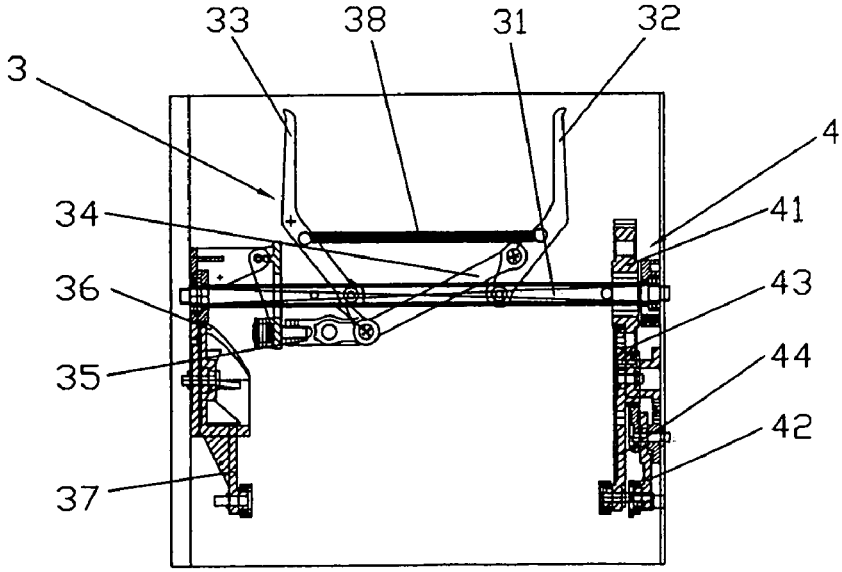
FIG. 4 is a structural schematic view of the separation and hooking mechanism of an automatic shoe cover dispenser according to one embodiment of the present invention.
Figure 5:
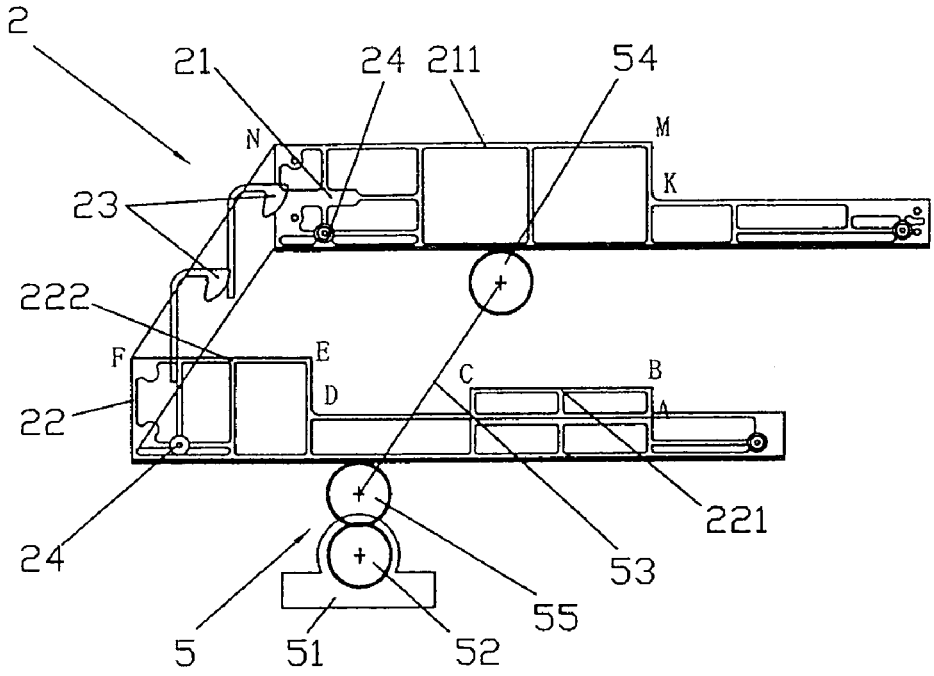
FIG. 5 is a structural schematic view of the traction and extension mechanism of an automatic shoe cover dispenser according to one embodiment of the present invention.

Referring to FIGS. 3-4, the separation and hooking mechanism 3 for the automatic shoe cover dispenser of the present invention includes a supporting arm 31, a first separating hook 32, a second separating hook 33, hook linkage arms 34, 35, a switching control guide rail 36 and a guide rail linkage arm 37. The supporting arm 31 is provided inside the box body of machine body 1. The first separating hook 32 and the second separating hook 33 are respectively connected to the support arm 31. Hook linkage arms 34, 35 are in active connection with the first and second separating hook 32, 33, respectively, and connected to switching control guide rail 36. One end of guide rail linkage arm 37 is connected to switching control guide rail 36 and the other end is connected to the first slide rack 21 provided on the side surface inside the machine body 1. A spring 38 is provided between the first and second separating hooks 32, 33 for connection therebetween. Switching control guide rail 36 is fixed on the side walls inside the machine body 1.

Figure 6:
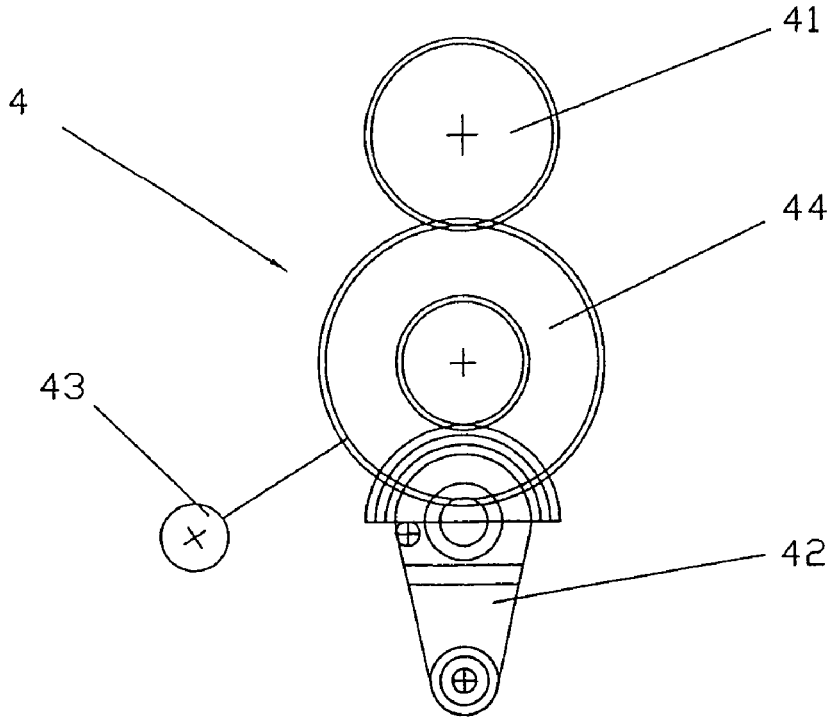
FIG. 6 is a structural schematic view of the turning mechanism of an automatic shoe cover dispenser according to one embodiment of the present invention.
Figure 7:
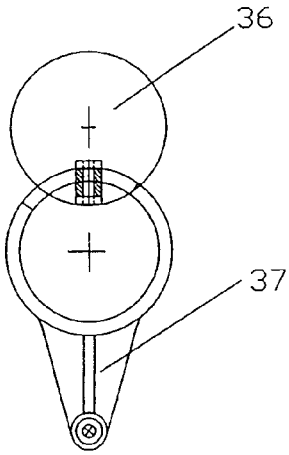
FIG. 7 is a structural schematic view of the switching control guide rail and linkage arm of an automatic shoe cover dispenser according to one embodiment of the present invention.
Figure 8:
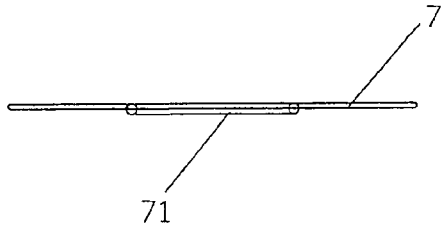
FIG. 8 is a schematic view of a shoe cover that is used according to one embodiment of the present invention

Referring to FIGS. 3, 4 and 6, the turning mechanism 4 for the automatic shoe cover dispenser of the present invention includes turning gear 41, upwards turning crank 42, downwards turning crank 43, and upwards turning gear 44. The turning gear 41 is provided on the supporting arm 31. One end of the upwards turning crank 42 and the downwards turning crank 43 are connected to the turning gear 41 on the supporting arm 31 and the other ends thereof are respectively connected to the second slide rack 22 provided on the inner side surface of the machine body 1. Upwards turning gear 44 is engaged with turning gears 41 and upwards turning crank 42 interlocks with the turning gear 41 of the supporting arm 31 through upwards turning gear 44, thus driving the first and second separating hooks 32, 33 on the supporting arm 31 to turn upwards. The downwards turning crank 43 works together with the turning gears 41 to drive the first and second separating hooks 32, 33 on the supporting arm 31 to turn downwards.

Referring to FIGS. 1-3 and 5, the traction driving mechanism 5 for the automatic shoe cover dispenser of the present invention is mounted on the machine body 1 and includes motor 51, motor gear 52, transmission shaft 53, double transmission gears 54, 55, and control switches (S1-S4). The motor 51 drives the double transmission gears 54, 55 through the motor gear 52 and transmission shaft 53. The transmission gears 54, 55 are connected with the first and second slide racks 21, 22, so that the motor can drive the first and second slide racks 21, 22 reciprocally. Control switches S1, S4 are provided on the front end part of slide rails 11 on the inner walls of both sides of the machine body 1 so that the front stop point S3 is on the rear end of slide rails 11 and the rear stop S2 is at a position of the slide rail 11 corresponding to the support arm 31 of separation and hooking mechanism 3.

Figure 11:
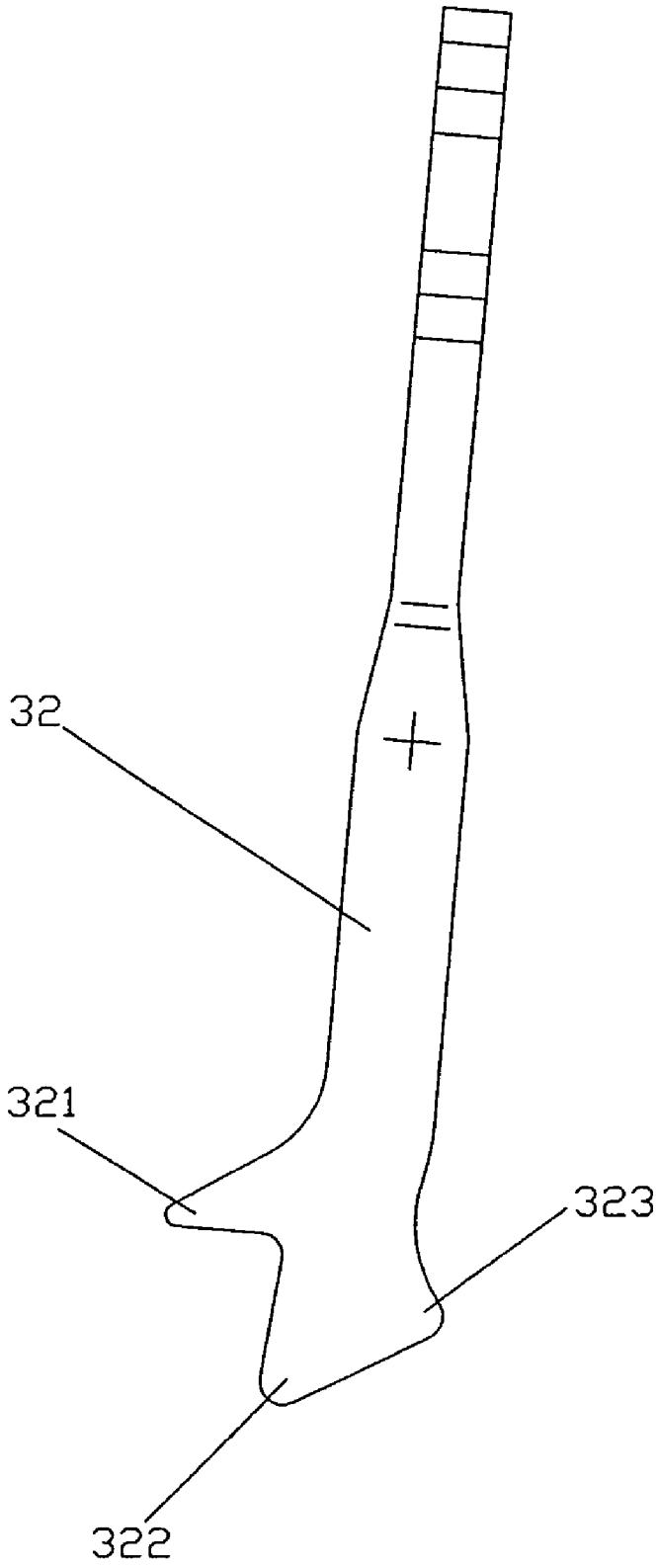
FIG. 11 is a structural schematic view of a separating hook that is used according to one embodiment of the present invention.
Figure 12A:
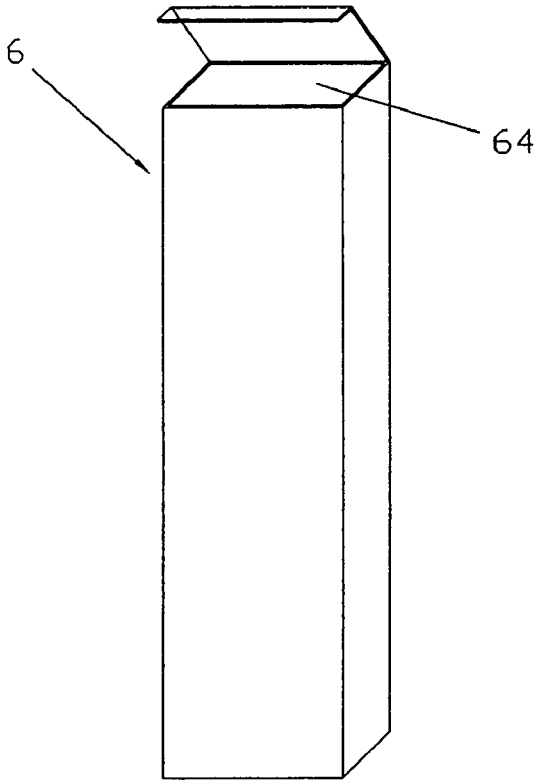
FIGS. 12A, 12B are schematic views of a shoe cover box that is used according to one embodiment of the present invention.
Figure 12B:
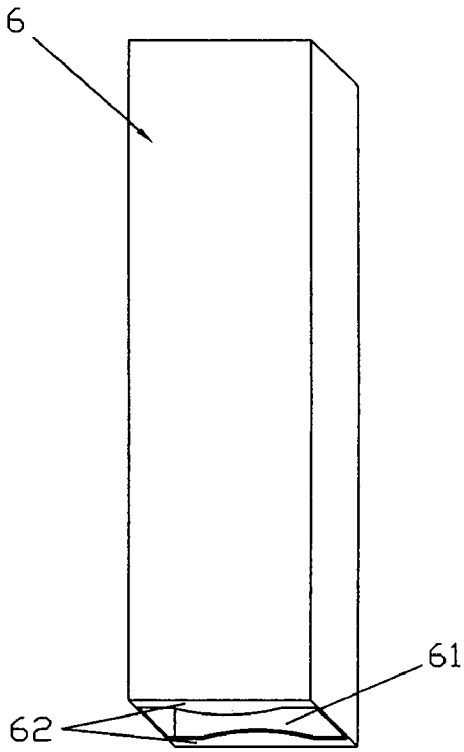

With reference to FIG. 11, the first separating hook 32 includes a first hook portion 321 facing upwards and a second separating hook portion 322 facing downwards that are formed on one end surface of the end part of the first separating hook. A third hook portion 33 is formed on the other end surface of the end part of the first separating hook in a reverse direction of the second hook portion 322. The first hook portion 321 can prevent the mouth of a shoe cover 7 from rising. The second hook portion 322 is easy to completely slip out while taking the shoe cover from the dispenser, and the third hook portion 323 can prevent the hooked shoe cover 7 from slipping away.

Referring to FIGS. 1, 3, 8, 12A and 12B, the shoe cover box 6 of the automated shoe cover dispenser according to one embodiment of the present invention is correspondingly provided at the position of support arm 31 of machine body 1. The bottom of the shoe cover box 6 is in communication with the machine body 1 and is a rectangular box body with a shoe cover loading entry 64 at the top end thereof. A shoe cover separating exit 61 is provided at the bottom end of the box body for the cover pulling mechanism of shoe cover dispenser to extend into, and stoppers 62 are provided at the shoe cover separating exit 61. The stoppers 62 comprise a group of stoppers which are symmetrically raised towards the middle of the shoe cover separating exit 61. The resulting symmetrically raised shape makes the cover pulling mechanism operate more reliably and allows only one shoe cover to be pulled out each time. A feeding block 63 is provided at the other end of the storage box 6 opposing to the shoe cover separating exit 61. A certain quantity of shoe covers 7 are stacked into the shoe cover box 6 and the openings thereof provided with rubber bands 71 are kept towards the shoe cover separating exit 61 and the feeding block 63 is loaded into the other end of storage box 6 opposing the shoe cover separating exit 61. Due to the pressure effects of the feeding block 63, the opening of shoe cover 7 provided with rubber band 71 is pressed close to the shoe cover separating opening 61.

Figure 13:
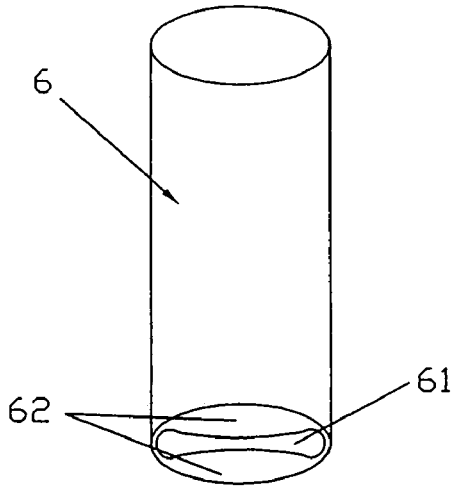
FIG. 13 is a schematic view of a shoe cover box in that is used according to another embodiment of the present invention.

FIG. 13 shows a shoe cover box 6 for an automatic shoe cover dispenser according to another embodiment of the present invention. In this embodiment, the only difference from the previous embodiment is that the box body has an elliptical cylinder shape.

The box body of shoe cover box 6 and the stoppers 62 are formed from folded cardboard and the stoppers are integrated with the box body. This makes the structure of this utility model simple, and easy to produce.

The shoe cover loading entry is provided at the top of the box body. In alternative embodiments, the shoe cover loading entry can also be provided at the shoe cover pulling exit which has not been folded. A shoe cover packaging box with hundreds of shoe covers can be inserted into the shoe cover dispenser which makes the use of automated shoe cover dispenser very convenient.

Figure 14:
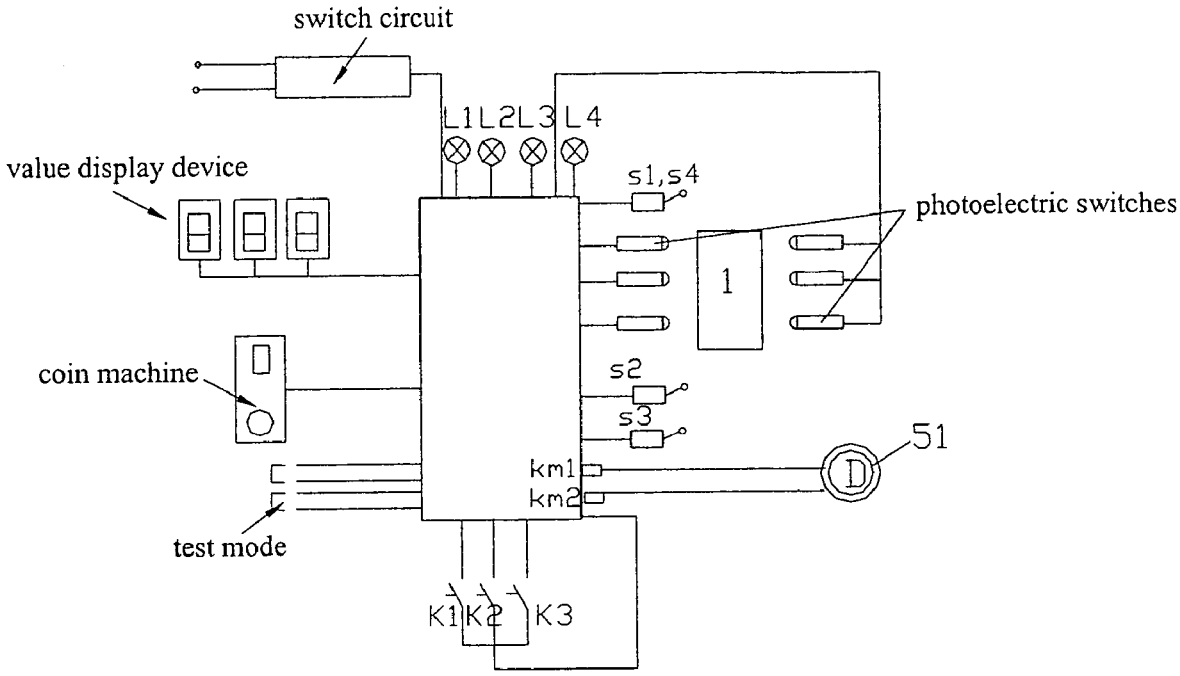
FIG. 14 is a diagram of an electric control circuit that is used according to one embodiment of the present invention.

Referring to FIG. 14, photoelectric switches are respectively provided on the inner walls of both sides of machine body 1 along the length direction of slide rail 11. The photoelectric switches are respectively electrically connected with traction driving mechanism and can switch off the operation of traction driving mechanism.

The automated shoe cover dispenser of the present invention is operated as follows:

As shown in FIG. 14, before power is on, the status of the electrical switches are that S1, S2, S4 are closed, S3 is disconnected, and solenoids km1, km2 released. When power is turned on, for instance at the time that the motor 51 receives DC 12V forward voltage, the motor 51 starts to rotate forward, driving the first and second slide racks 21, 22 forward through motor gear 51, transmission gears 54, 55 and transmission shaft 53 so as to move synchronously in the direction of storage box 6, as indicted in FIG. 5.

The orbit AB segment on the second slide rack 22 contacts and drives the upwards turning crank 42 causing it to rotate, and drives the first and second separating hooks 32, 33 to turn upwards in the direction of shoe cover separating opening 61 through the upwards turning crank 42, downwards turning crank 43, turning gear 41, and support arm 31 (refer to FIG. 4). At this time, the bottom end of switching control guide rail 36 has not been extended by the guide rail linkage arm 37 and is in the state of free oscillation and the separating hook linkage arm 34 is not limited by the switching control guide rail 36 during the separating hooks 32, 33 turning upwards. Therefore, the hook ends of the first and second separating hooks 32, 33 are gradually gathered up by the influence of spring 38. When the bottom end of upwards turning crank 42 reaches B point of the orbital segment of the second slide rack 22, the hook ends of separating hooks 32, 33 have already been completely gathered up and inserted into the opening (and rubber band 71) of one shoe cover 7 located in the front of the stack of shoe covers in the storage box 6 through shoe cover separating opening 61. Then, the BC orbit segment of the second slide rack 22 maintains this state while the KM orbit segment on the first slide rack 23 starts to contact and drive guide rail linkage arm 37 causing it to rotate. The bottom end of the switching control guide rail 36 is extended by the guide rail linkage arm 37 and swings outwards and open so that the separating hook linkage arm 34 in contact with the bottom end of guide rail 36 is shifted to drive the end part of separating hooks 32, 33 to gradually stretch out to an open position and hook up to the opening of shoe cover 7 (provided with rubber band 71). When the bottom end of guide rail linkage arm 37 moves to point M of the orbital segment of the first slide rack 23, the opening of shoe cover 7 (provided with rubber band 71) is opened to its maximum by the end part of separating hooks 32, 33. Then, the MN orbital segment of the first slide racks 23 will maintain such a state. As the first and second slide racks 21, 22 continue to move forward, the bottom end of upwards turning crank 42 disengages and is out of control from the BC orbit segment of the second slide rack 22. Then, the DE orbit segment of rack 22 starts to contact and drive the downwards turning crank 43 causing it to rotate, thereby driving the separating hooks 32, 33 and causing them to turn downwards in is an open status through turning gear 41 and support arm 31, thereby pulling out a shoe cover 7 in the storage box 6 which has been opened and hooked up from the shoe cover separating opening 61. Due to the pressure effects of the feeding block 63, the other shoe covers 7 stacked behind the shoe cover which has been pulled out of the storage box 6 move towards the direction of shoe cover separating opening 61 and the opening of the next shoe covering 7 (with rubber band 71) will press close to the shoe cover separating opening 61 to be ready to be pulled out next time.

Figure 9:
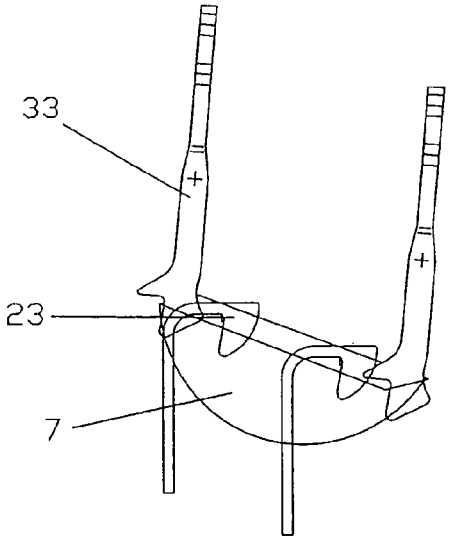
FIG. 9 is a schematic view of the shoe cover of FIG. 8 before stretching.

When the bottom end of downwards turning crank 43 moves to point E of the orbital segment of the second slide rack 22, the end parts of separating hooks 32, 33 with a shoe cover 7 are positioned in the lowest limiting point to wait for the pulling of traction hook 23 of traction and extension mechanism 2. Meanwhile pressure on the control switch S2 causes the control switch to become disconnected so that EF orbit segment of the second slide rack 22 will maintain in such a state. At this time, the first and second slide racks 21, 22 continue to move forward. When the traction hook 23 moves into the opening of shoe cover 7 (provided with rubber band 71) which has been opened up by separating hooks 32, 33 (as shown in FIG. 9), slide racks 21, 22 move forward to the rear stop point and trigger the control switch S3, causing it to become closed. As a result, solenoids km1 and km2 are attracted and motor 51 obtains 12V reverse DC voltage and starts to turn reversely. Meanwhile drive slide racks 21, 22 move backwards, the traction hook 23 hooks up the rubber band 71 at one end of the opening of the shoe cover 7. As the slide racks 21, 22 move backwards, the opening of shoe cover 7 (provided with rubber band 71) gradually expands. Meanwhile, switch S3 is released, solenoid km1 coil supplies power for protecting itself, and the circuit status remains unchanged. In the process of the first and second slide racks 21, 22 moving backwards, first the bottom end of upwards turning crank 42 is driven by three orbital segments on the second slide rack 22 to rotate in reverse direction. Because the upwards turning crank 42 and upwards turning gear 44 are moving separately, such movement will not cause the turning mechanism 4 to operate. Then, the bottom end of downwards turning crank 43 also breaks away from EF orbital segment with the moving backwards of the second slide rack 22. Due to the traction effect created by the rubber band 71 on the shoe cover 7 being pulled by traction hook 23, the ends of separating hooks 32, 33 still remain unchanged in the original lowest limiting position. Then, the bottom end of guide rail linkage arm 37 also starts to break away from the MN orbital segment of the first slide rack 21. At this time the separating hook linkage arm 34 is already located in the highest supporting point for oscillation and rotation of switching control guide rail 36 and will not change from this state due to the fact that the bottom end of switching control guide rail 36 loses control and oscillates freely. Therefore, the separating hooks 32, 33 are in the state of always being open in the process of shoe cover 7 being extended.

Figure 10:
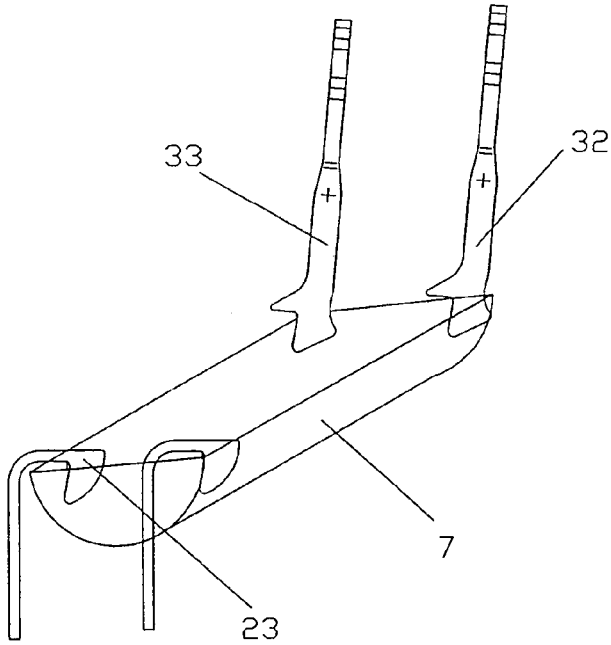
FIG. 10 is a schematic view of the shoe cover of FIG. 8 after stretching.

When the first and second slide racks 21, 22 move to the front stop point, the traction hook 23 extends the shoe cover 7 to its maximum shape (as shown in FIG. 10). Meanwhile switches S1, S4 are disconnected. As a result, solenoids km1, km2 are released and motor 51 stops operation and the machine is in the shoe cover waiting status. At this time when a person puts his/her foot inside the stretched shoe cover 7 with the tread down, the opening of the shoe cover 7 (provided with rubber band 71) will break away from the control of separating hooks 32, 33 and traction hook 23 and will automatically wrap around the person's foot. Meanwhile, as the separating hooks 32, 33 have lost the pulling effects of rubber band 71 of shoe cover 7 control switch S2 is released and becomes closed and the traction driving mechanism 5 starts once again to repeat the above-mentioned movement process to automatically wrap the shoe covers 7 in the storage box 6 on shoes one by one.

The invention claimed is:

1. An automatic shoe cover dispenser, comprising:

a machine body having the structure of box body with an opening on a top surface thereof and slide rails provided on inner walls of both sides thereof;

a traction and extension mechanism having a first slide rack, a second slide rack and traction hooks provided at an end of the slide racks, the first and second slide racks are respectively provided on an inner surface of the machine body, and step-shaped linkage orbital segments are provided on the first and second slide racks, a step is formed on the first slide rack, so that an end surface of the step switches control orbital segments, two discontinuous steps are formed on the second slide rack along its length direction, so that end surfaces of the two steps and an end surface between the two steps turn control orbital segments, guide rail rollers are further provided on the first and second slide racks, and guide rail rollers are engaged with the guide rails on a side surface of the machine body;

a separation and hooking mechanism having a supporting arm, a first separating hook, a second separating hook, hook linkage arms, switching hook linkage arm, and switching control guide rail and guide rail linkage arm, the supporting arm is provided in the box body of the machine body, the first separating hook and the second separating hook are respectively connected to the supporting arm, hook linkage arms are in active connection with the first, second separating hooks, respectively, and connected with switching control guide rail, one end of guide rail linkage arm is connected to switching control guide rail, and another end of guide rail linkage arm is connected with the first slide rack provided on the inner side surface of the machine body, the switching control guide rail is fixed on the inner side wall in the machine body;

a turning mechanism having a turning gear, an upwards turning crank, a downwards turning crank, and an upwards turning gear, the turning gear is provided on the supporting arm, one end of upwards turning crank and downwards turning crank is connected to turning gear on the supporting arm, and another end of upwards turning crank and downwards turning crank is respectively connected to the second slide rack on the inner side surface of the machine body, the upwards turning gear is engaged with turning gear, the upwards turning crank interlocks with the turning gear of the supporting arm through the upwards turning gears, thus driving the first, second separating hooks on the supporting arm to turn upwards, the downwards turning crank is engaged with the turning gear to drive the first, second separating hooks on the supporting arm to turn downwards;

a traction driving mechanism provided on the machine body and including a motor, a motor gear, a transmission shaft, double transmission gears and control switches, the motor functioning to drive the double transmission gears through motor gear and transmission shaft, the transmission gear being connected with the first and second slide racks, so that the first and second slide racks can be reciprocally driven; and a shoe cover box, mounted on the machine body, a bottom of the shoe cover box in communication with the machine body to form a shoe cover separating exit in which the traction and extension mechanism extends, stoppers being provided on the shoe cover separating exit and a shoe cover packaging box in which shoe covers are stacked, the shoe covers having openings that are provided with rubber bands, which openings face the shoe cover separating exit.

2. An automatic shoe cover dispenser according to claim 1, said stoppers comprise symmetric stoppers which are raised towards the middle of the shoe cover separating exit.

3. An automatic shoe cover dispenser according to claim 1, wherein said box body and stoppers of shoe cover box are made from pieces of folded cardboard and the stoppers and box body are integrated.

4. An automated shoe cover dispenser according to claim 1, further comprising a feeding block that is provided on another end of the shoe cover box opposite to the shoe cover separating exit.

5. An automatic shoe cover dispenser according to claim 1, further comprising a spring that is provided between the first and the second separating hooks for connection therebetween.

6. An automatic shoe cover dispenser according to claim 1, wherein a first upwards and a second downwards hook are formed on one end surface of the ends of the first and second separating hooks and a third hook is formed on the another end surface of the first and second separating hooks in a reverse direction of the second hook.

7. An automatic shoe cover dispenser according to claim 1, further comprising photoelectric switches that are provided along a length direction of slide rail on both sides inside the machine body, which photoelectric switches are electrically connected with the traction driving mechanism respectively and can switch off the operation of traction driving mechanism.

* * * * *